US005166885A

United States Patent [19]

Thompson

[11] Patent Number: 5,166,885

[45] Date of Patent: Nov. 24, 1992

[54] NON-DESTRUCTIVE MONITORING OF SURFACES BY 3-D PROFILOMETRY USING A POWER SPECTRA

[75] Inventor: Robert A. Thompson, New York, N.Y.

[73] Assignee: General Electric Company, Schenectady, N.Y.

[21] Appl. No.: 646,957

[22] Filed: Jan. 28, 1991

[51] Int. Cl.[5] ..... B24C 1/10; G06F 15/46

[52] U.S. Cl. ..... 364/473; 72/53; 51/415

[58] Field of Search ..... 364/472, 473, 474.03, 364/474.05, 474.37; 51/415, 319, 324; 72/53, 37, 9, 10

[56] References Cited

U.S. PATENT DOCUMENTS

| | | | |
|---|---|---|---|
| 4,514,812 | 4/1985 | Miller et al. | 364/473 |
| 4,805,429 | 2/1989 | Thompson | 72/53 |
| 4,873,855 | 10/1989 | Thompson | 72/53 |
| 5,003,805 | 4/1991 | Thompson | 72/53 |
| 5,059,265 | 10/1991 | Asakura | 364/473 |

*Primary Examiner*—Jerry Smith
*Assistant Examiner*—Jim Trammell
*Attorney, Agent, or Firm*—James R. McDaniel; Paul R. Webb, II

[57] ABSTRACT

A method for monitoring the surface treatment of substrates is disclosed. The surface treatment, preferably, is shot peening. The surface treatment is monitored through the use of a selective spectral analysis of the 3-D information relating to the 3-D profilometry of the surface treatment on the substrate.

5 Claims, 9 Drawing Sheets

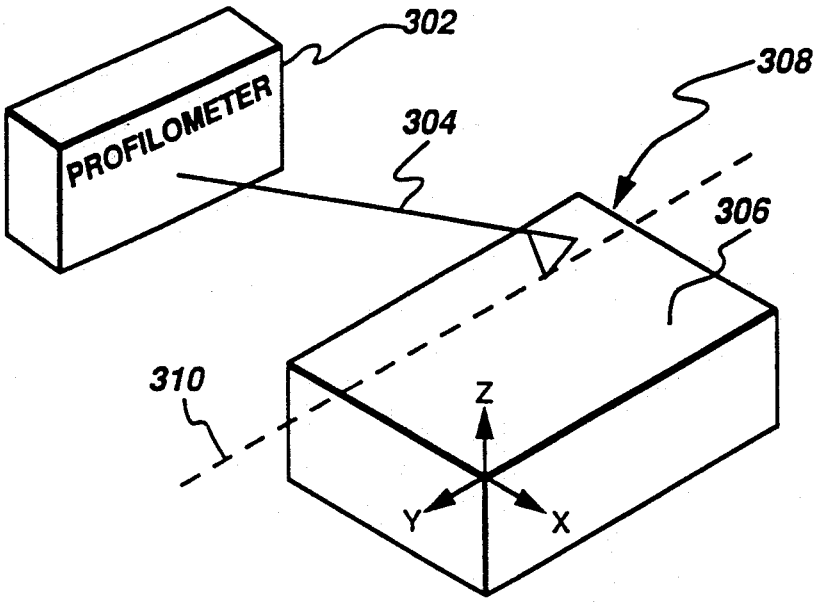
Fig. 3
Fig. 4
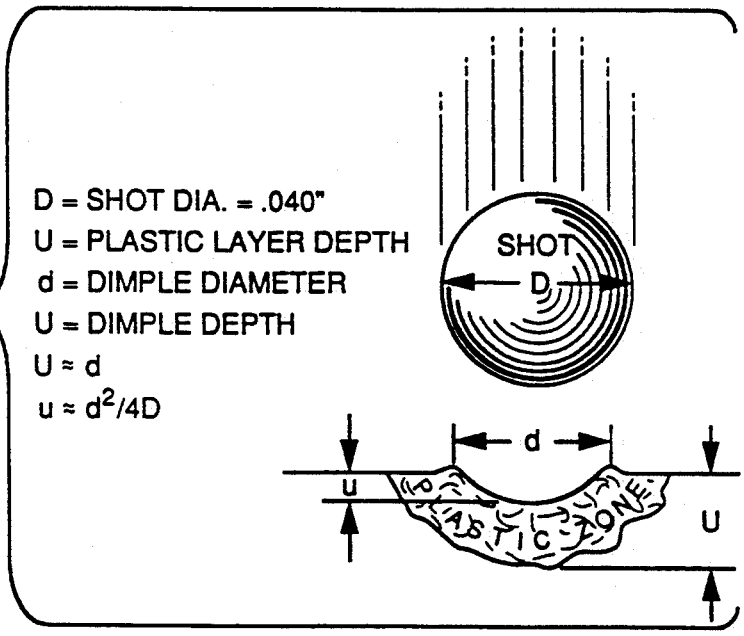
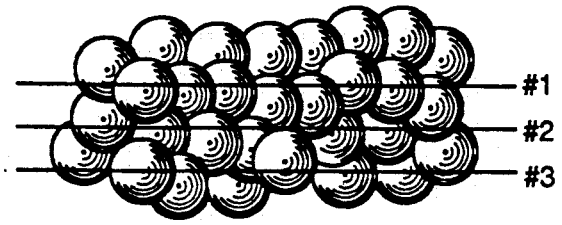
Fig. 5

NON-DESTRUCTIVE MONITORING OF SURFACES BY 3-D PROFILOMETRY USING A POWER SPECTRA

BACKGROUND OF THE INVENTION

This invention relates to surface monitoring systems of the type that employ a three dimensional, hereinafter referred to as 3-D, non-destructive profilometry to directly measure the surface compression layer depth resulting from a surface treatment, of a substrate, such as, a shot peening treatment. Such systems of this type generally allow the compression layer depth to be directly measured without having to destruct the substrate, typically, by cutting the substrate using conventional cutting techniques such that the surface treatment operation can be monitored to determine if the desired compression layer depth is being achieved. In particular, lines are traced across a substrate which has been surface treated, for example, by shot peening and these line traces are transformed into 3-D surface profilograms which measure the intensity of the surface treatment. This invention relates to certain unique 3-D, non-destructive, surface treatment monitoring systems and monitoring means in association therewith.

During a surface treatment operation such as a shot peening process, a stream of shot (i.e., particles), travelling at a high velocity, is directed at a workpiece surface. The shot is directed at the workpiece so as to cause plastic deformation of the workpiece surface, which often is a metal surface. Although the process may be applied for other purposes, the shot peening process generally is used to increase fatigue strength of the workpiece.

For example, residual stress near the surface of high performance machine parts is directly related to the fatigue life of the part. If the surface is in a state of residual compression, the growth of microcracks created by, for example, hard processing, should be inhibited. Shot peening is a very effective means for producing surface compression residual stress, and therefore, prolonging the useful life of the part.

Determining the state of surface compression due to shot peening, however, has proven to be very difficult. There are currently several methods used to measure surface compression. In particular, there is a direct method for determining surface compression due to shot peening. Under this direct method the workpiece is cut apart by conventional cutting techniques, and then the depth, i.e. the thickness, of the surface compression is physically measured. This direct method is time consuming and requires destructing the part being analyzed. A more advantageous system, then, would be presented if such amounts of time and destruction were reduced.

Another known method for determining surface compression due to shot peening which is less time consuming and avoids the destruction of the workpiece is referred to as an indirect Almen method. In the Almen method, a strip of material is shot peened, and then the strip is analyzed to determine the surface compression due to the shot peening. The Almen method is indirect, in that, the effects of shot peening are not measured directly from a workpiece, rather, a substitute or Almen strip is utilized. However, the Almen strip method is subject to insensitivity due to process changes which may occur in the peening operations between Almen strip checks. Also, when peening workpieces having contoured surfaces, it is difficult to reproduce the peening conditions on the contour surfaces with an Almen strip which is usually flat. Finally, variations in the Almen strips themselves render the Almen strip method subject to error. Consequently, a still more advantageous system would be presented if such amounts of insensitivity, inapplicability and variations could be reduced while still avoiding the destruction of the workpiece.

Finally, there has been developed a method and system for monitoring shot peening which utilizes two-dimensional, hereinafter referred to as 2-D, line trace information. Exemplary of such a prior art system is U.S. patent application Ser. No. 473,781 to Thompson entitled "A Method and System for Monitoring Shot Peening" and assigned to the same assignee as the present invention. While this system has met with a degree of commercial success, the system is limited in that only a mere 2-D view of the surface treatment intensity can be obtained. Therefore, a further advantageous system, then, would be presented if a more complete analysis of the surface treatment could be presented.

It is apparent from the above that there exists a need in the art for a substrate surface treatment monitoring system which will not destruct the substrate in order to monitor the surface treatment, but which will monitor the surface treatment on the substrate surface in a manner which provides a full and complete analysis of the surface treatment through the use of 3-D profilometry. It is a purpose of this invention to fulfill this and other needs in the art in a manner more apparent to the skilled artisan once given the following disclosure.

SUMMARY OF THE INVENTION

Generally speaking, this invention fulfills these needs by providing a method for monitoring a surface treatment operation, a system user having predetermined a desired total plastic upset depth for said surface treatment, and having predetermined a amount of surface treatment data to be omitted, said method comprising the steps of obtaining a profile data of a workpiece surface which has been surface treated such that said profile data is being obtained in a nondestructive, direct, and three-dimensional manner; selecting an area of surface treatment on said workpiece to be analyzed; obtaining power spectra data of said area; filtering said power spectra data to substantially filter out said predetermined amount of surface treatment data; calculating an average peak value of said surface treatment; calculating an actual plastic upset depth for the selected area: and adjusting, if needed, the surface treatment operation so that an actual total plastic upset depth of a subsequently formed surface treated area should be substantially in conformance with said predetermined desired total plastic upset depth.

In certain preferred embodiments, the surface treatment is a shot peening operation. Also, the profile data is obtained by a 3-D profilometer having a stylus or some other means of measuring surface height such as a non-contacting type. Finally, the area to be analyzed is, preferably, a dent in the surface of the workpiece.

In another further preferred embodiment, the surface treatment of the substrate is monitored by selective spectral analysis of 3-D information rather than a 2-D line trace evaluation.

In particularly preferred embodiments, the monitoring systems of this invention consists essentially of a raw 3-D profilograms of sample surface treatment areas to be measured, power spectra of those same samples, filtering by electronic filters of those power spectra to substantially eliminate undesirable extraneous information, quantizing the information that was not filtered out to arrive at an average peak value of the surface treatment, and comparing those quantized values with predetermined values to determine, if any, adjustments should be made to the surface treatment device.

The preferred surface treatment monitoring system, according to this invention, offers the following advantages: ease of use; excellent monitoring characteristics; good stability; good durability; and good economy. In fact, in many of the preferred embodiments, these factors of ease of use and monitoring characteristics are optimized to an extent considerably higher than heretofore achieved in prior, known surface treatment monitoring systems.

BRIEF DESCRIPTION OF THE DRAWINGS

FIG. 3 illustrates, in block diagram, a profilometer operating to gather profile data from a workpiece;

FIG. 4 illustrates a shot impact model;

FIG. 5 illustrates a top view of three line traces across a surface treated substrate;

DETAILED DESCRIPTION OF THE INVENTION

Before discussing the specifics of a preferred embodiment of the present invention, it will be useful to discuss the physics of a surface treatment operation, preferably, a shot peening process. When a workpiece surface is subject to plastic deformation under the shot peening process, the beneficial effect of the process depends upon the shot particle energy. The energy depends upon the product of the particle mass and velocity squared.

Newton's second law of motion provides that force is equal to the change in the amount of motion, the amount of motion being mass (m) times velocity (v). The relationship may be stated as follows:

$$F = \frac{d}{dt}(mv) = m\frac{dv}{dt} + v\frac{dm}{dt}. \quad (1)$$

Typically, the above equation reduces to F=ma where a is acceleration. Acceleration is equal to the change in velocity over a period of time, and acceleration corresponds to the first term on the right side of Equation 1. In the case of a shot peening gun operating under steady state conditions, velocity does not change. Therefore, acceleration equals zero.

Accordingly, under steady state conditions, force (F) is equal to the velocity times the mass differential. The application of Equation 1 to a shot stream may be thought of as somewhat analogous to withdrawing a rope from a box by pulling the rope at a constant velocity. The first term of the equation is zero because the time differential of the velocity is zero. However, the second term of Equation 1 would be applicable, in that the mass of the rope in the box is changing as the rope is pulled from the box.

In somewhat similar fashion, the change in the amount of motion of a stream of shot is its mass flow rate times its velocity. Thus, the velocity (v) of a stream of shot is equal to:

$$v = \frac{F}{R}, \quad (2)$$

wherein R is used to indicate the mass flow rate and corresponds to dm/dt, and v is the average velocity of the shot stream.

From Equation 2 above, it will be seen that the average velocity of the shot stream may be calculated if the mass flow rate (R) and the force (F) of the shot stream can be calculated. The system described in Thompson, U.S. Pat. No. 4,805,429, titled "Shot Peening System and Method With Velocity Sensing", which is assigned to the present assignee, senses F by sensing the reaction force of the shot peening gun. This reaction force is equal and opposite, in direction, from the force of the shot and gases which are expelled from the shot peening gun. A flow controller, usually disposed adjacent a shot hopper, provides mass flow rate (R).

Figure 1:
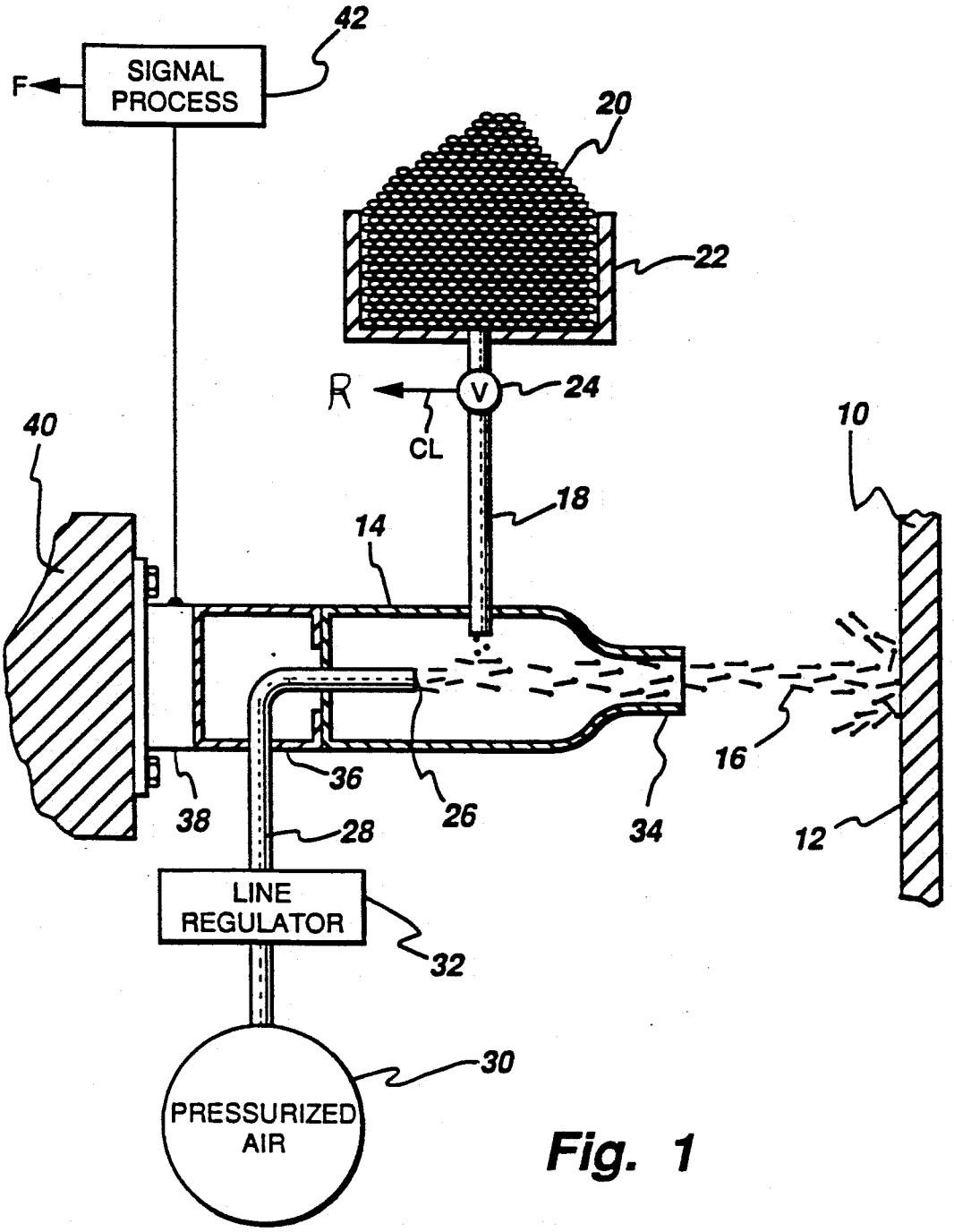
FIG. 1 shows a simplified schematic of a shot peening system.

FIG. 1 shows a shot peening operation. In particular, workpiece 10 has a surface 12 which is being subjected to shot peening from a shot peening gun 14. The shot peening gun 14 establishes a shot blast path 16 by expelling shot supplied to gun 14 through shot feedline 18 which carries shot 20 from hopper 22. The shot is supplied to feedline 18 by way of flow controller 24. The flow controller may be a common type of flow controller using an electromagnet to dispense metered amounts of metallic shot, although other types of flow controllers might be used. The flow controller 24 supplies a mass flow rate signal (R) in known fashion as shown through control line CL. Signal R represents the amount of shot which is supplied to the feedline 18 and, therefore, the amount of shot expelled by the gun 14 absent, for example, a blockage or other system malfunction.

The shot supplied to the gun 14 from feedline 18 is entrained in pressurized air from an air expansion nozzle 26 at the end of air supply conduit 28. The air supply conduit 28 provides pressurized air from pressured air source 30 by way of line regulator 32, which is used in known fashion to regulate and adjust the air pressure supplied to the gun 14. The pressure of the air supplied to the nozzle 26, among other factors, helps to determine the velocity of the shot expelled from the nozzle 34 and gun 14. The gun 14 is mounted to a bracket 36.

The components of FIG. 1 which are discussed above are relatively standard components. Shot peening gun 14 is a gravity type of shot peening gun. Other types of shot peening guns such as a suction lift gun or pressure pot gun may also be utilized.

In order to obtain the force magnitude data specified by Equation 2, gun 14 includes a bracket 36 which is mounted upon a force sensor 38. The force sensor 38 is disposed between the gun 14 and mounting base 40 which supports the gun 14. The force sensor 38 is preferably a directional strain gauge which should detect forces parallel to the direction in which shot is ejected from gun 14. However, the force sensor 38 should also detect the reaction force of the gun 14 as it ejects the shot in path 16. The force sensor 38 is connected to signal processing circuit 42 which supplies the force signal (F). Although other force sensors could be used, the force sensor 38 may be a commercially available Lebow load cell Model 3397 and the signal processing circuit 42 may be a corresponding commercially available transducer instrument 7530, these two components typically being sold as a package. The signal processing circuit 42 basically converts the output from force sensor 38 into a form corresponding to pounds of force such that the output may be displayed and/or recorded.

As should be apparent from the above discussion, the velocity of a shot stream can be adjusted by adjusting the force at which the shot is expelled. The force at which the shot is expelled may be adjusted, for example, by decreasing or increasing the flow of air into the gun from pressured air source 30. Also, for example, line regulator 32 may be utilized to achieve the force adjustment. The mass flow rate may be adjusted, for example, by adjusting the rate at which shot is expelled from hopper 22. Flow controller 24 may be utilized, for example, to make the mass flow rate adjustment.

Figure 2:
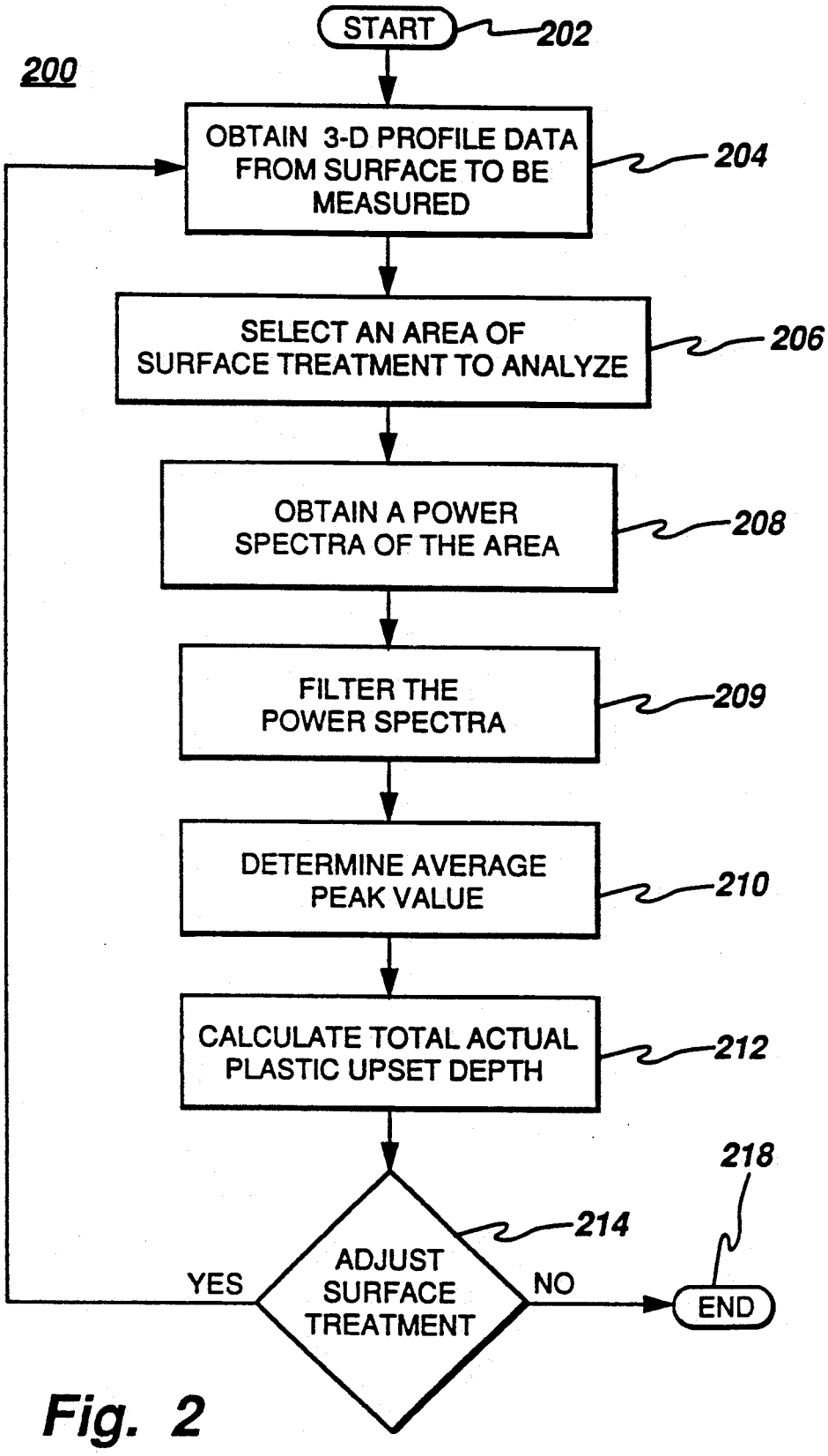
FIG. 2 is a flowchart illustrating a sequence of method steps in accordance with the present invention.

To monitor a shot peening operation, and in accordance with the present invention, after a workpiece surface has been peened, a system user initiates the process which is briefly illustrated as a flow diagram 200 in FIG. 2. The system user may, for example, be a human or a computer including a computer-controlled robotic unit. Specifically referring to flowchart 200, after the process has been initiated as indicated at a start block 202, the system user obtains a 3-D profile of the workpiece surface to be measured as indicated at block 204. The profile may be obtained by using a profilometer such as a commercially available profilometer known as a Taylor Hopson "Form Talysurf", available from Rank Taylor Hobson, Limited (British Company). Other profilometers either stylus or noncontacting such as that of the Wyko Corporation, with suitable sensitivity could provide the necessary profile data. From the profile data, the system user then selects an area of the substrate which has been surface treated to be analyzed as indicated at block 206. After the area has been selected, a power spectra of the area is obtained as indicated at block 208 through conventional techniques. Once the power spectra of the area is obtained, this power spectra is filtered as indicated at block 209 by software filters. This filtered information is then used to determine the average peak values of the surface treatment as indicated at block 210. The average peak values are used to calculate the total plastic upset depth as indicated at block 212. The total actual plastic upset depth is compared with the desired plastic upset depth to determine, if any, adjustments should be made to the surface treatment operation as indicated at blocks 214 and 216.

With respect to FIG. 3, a profilometer 302 including a stylus 304 is shown as operating to gather 2-D profile data from a surface 306 of a workpiece 308. The stylus and/or workpiece is moved so that the stylus remains in contact with surface 306 along a selected dimension such as along a line 310. As the stylus moves along surface 306 on line 310, it records information regarding the surface geometry as a 2-D topogram. When subsequent lines are profiled (by incrementally indexing the part in the x-direction) and placed side by side in the proper sequence with neighboring lines the third dimension (x) is established and a 3-D topogram results.

In theory, 3-D topograms of shot peened surfaces contain information about the intensity of the process. That is, according to specific laws derived from the shot peening model, the depth of the plastic rework layer or shot peening intensity is related, typically, to surface wave frequency and height.

In what follows, the laws tying intensity to surface wave frequency and height are derived and it is shown that 3-D profilograms of shot peened samples made under the flat surface model validation program agree with these laws. Thus, 3-D profilometry forms a basis for non-destructive monitoring of shot peened surfaces.

An empirical law of shot peening states that the depth of the plastic rework (or compressive) layer produced by shot impact roughtly equals the diameter of the impact crater. A second law, based on geometry for a spherical indentor states that the depth of the shot induced crater goes roughly as its diameter squared.

With this in mind, consider FIGS. 4 and 5. FIG. 4 shows a single impact. It gives the nomenclature used and illustrates the laws mentioned above. FIG. 5 presents a view down onto a shot peened surface with multiple impacts (assume no machining marks, etc. for now). In it, trace #1 across the surface shows a wavy profile whose spatial frequency should equal about 1/d. Thus, the period of this trace should be d, and by the first law of shot peening, as discussed above, it would be a direct measure of the plastic upset depth U. By a similar argument, d, could also be related to the depth of the dimples u, wherein:

D = effective shot diameter, preferably, 0.040"
U = plastic layer depth (total plastic upset depth)
d = dimple diameter
u = dimple depth
$U \cong d = 2(uD)^{\frac{1}{2}}$
$u \cong d^2/4D$ Now, trace #2 shows a somewhat higher frequency and shallower average bumps and trace #3 shows still higher frequency and shallower values. Therefore, a 3-D power spectrum derived from 20 lines of Form Talysurf data such as that made for the shot peened parts should tend to show frequencies shifted toward the high side. However, since the deepest dimples (Trace #1) are associated with the lowest frequency, the power spectrum should tend to show peak wave power at the frequency associated with the reciprocal dimple diameter (1/d). For this reason, the power spectrum peak will have two pieces of information related directly to peening intensity. First, its frequency will be near the reciprocal of d. Second, through the geometry law, its amplitude will be related to u and thus, also to d and with it, U.

Consider now the profile data generated for the shot peened surface. The form talysurf data for the parts consisted of a 3-D profile recorded on a conventional magnetic disk by well known recording techniques. This data was made up of, preferably, 20 half inch long lines, each line containing, preferably, 1500 data points. The lines were separated, preferably, by 0.005 inches so, typically, a region 0.10×0.50 inches was profiled for each part.

The vertical resolution of the Talysurf was, preferably, about 0.5 microinches and it had, preferably, a 0.08 mil diameter stylus so it could resolve waves with spatial frequencies, preferably, up to about 12500 cycles/inch.

Figure 6:
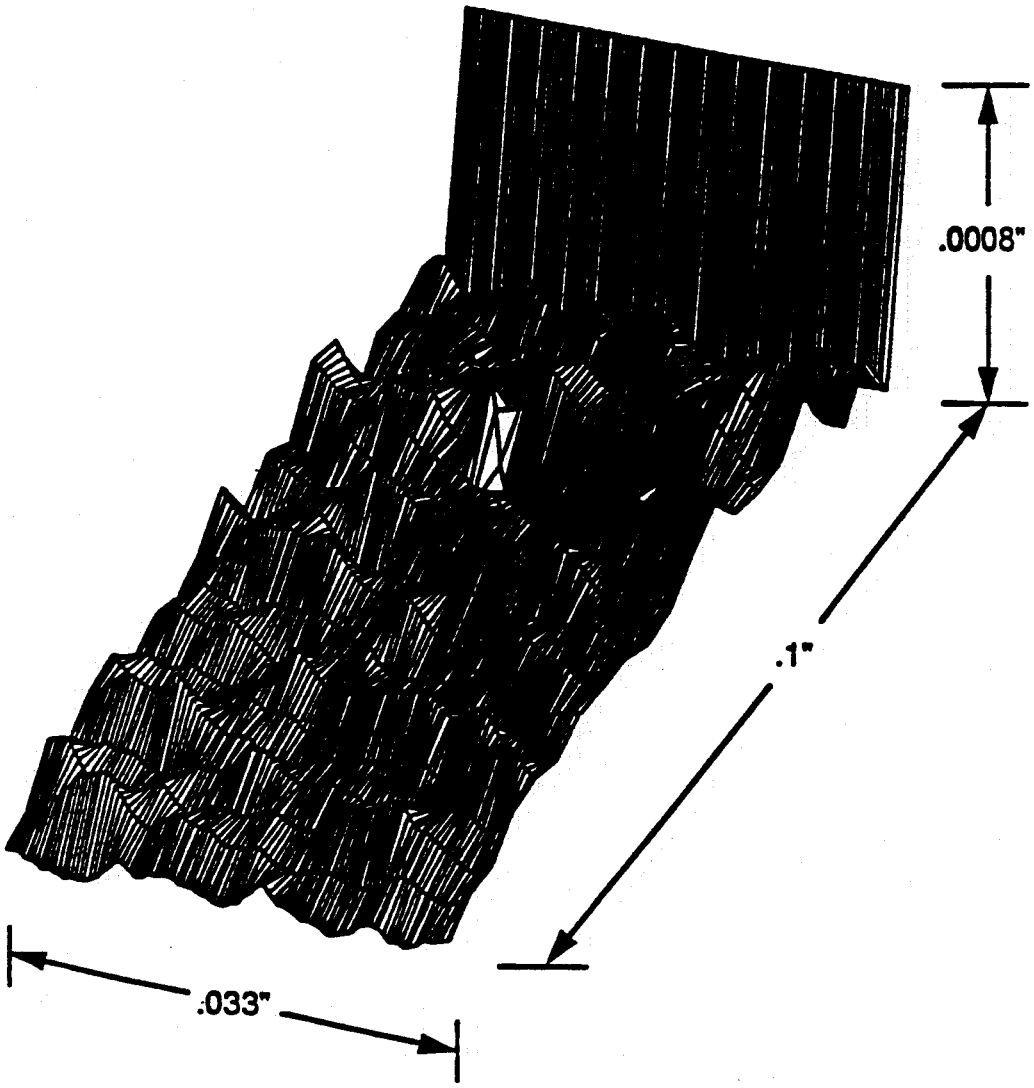
FIG. 6 illustrates the raw 3-D profilograms for a sample surface treatment run with an Almen number of 7.9.

The associated spectral analysis was run on a supported software, preferably, "PROMATLAB" from data recorded on the magnetic disks. FIG. 6 shows a raw 3-D profilogram for the sample to be monitored. The plot consists, preferably, of 20 line traces in the 0.1 inch direction, each line being made up, preferably, of 100 data points so the other dimension is, preferably, (100/1500)×0.500"=0.033". Preferably, a 0.0008" high back drop is also provided as a scale for the height of the surface waves. Some low frequency waviness can be seen in FIG. 6, probably due to, for example, machining marks when the substrate was machined prior to substrate treatment.

Figure 7:
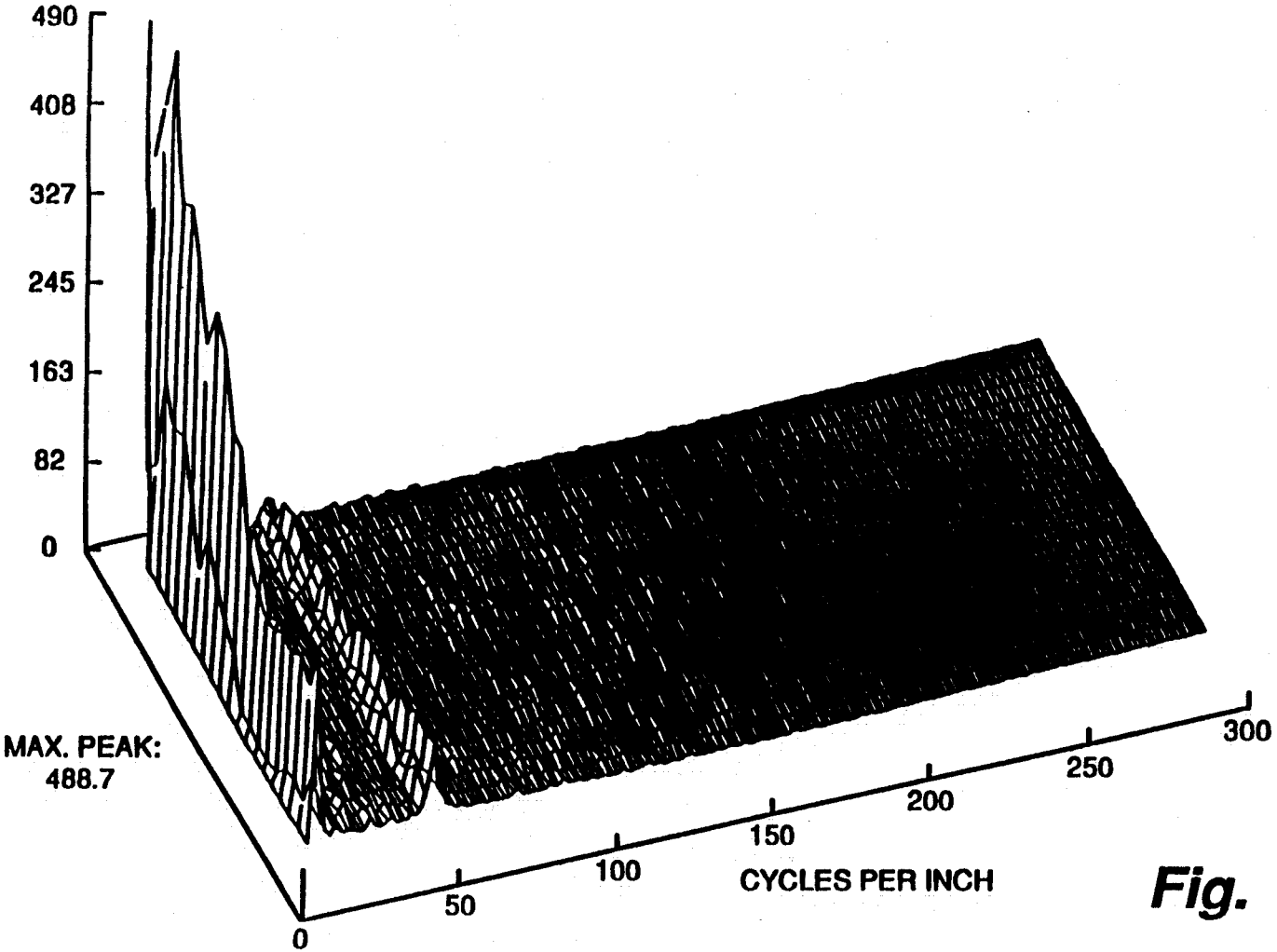
FIG. 7 illustrates a 3-D power spectra for the same sample as in FIG. 6.

Consider next FIG. 7. It is a 3-D power spectra for the same sample as shown in FIG. 6. The vertical scale of this plot, preferably, is proportional to the surface wave height squared so differences in wave height from part to part, typically, are accentuated by the power spectra.

In this sample most of the waviness, typically, is in the 50 cycles/inch range or lower. Typically, a 50 cycles/inch wave would correspond to machining marks if the crossfeed was 0.020 inches/revolution. The source of the very long waves (low frequency) is not known. Remember, the expected shot peening information is, preferably, in the 80 to 300 cycles/inch range.

Figure 8A:
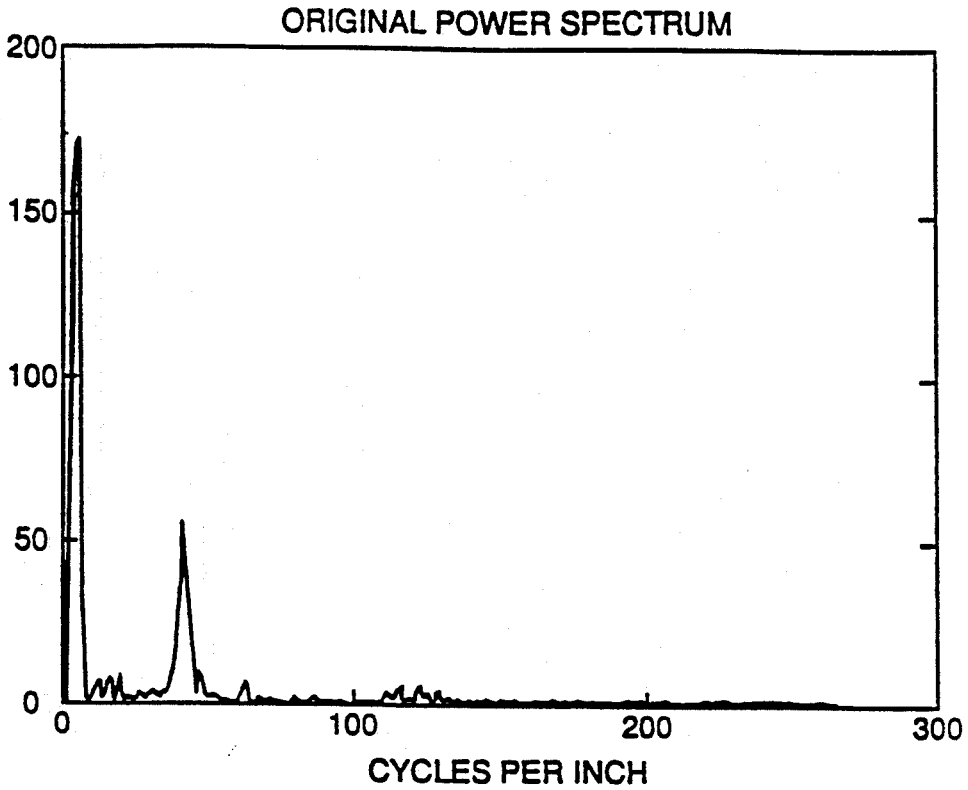
FIG. 8*a*–8*d* illustrate the original signal and its spectrum for the same sample as in FIG. 6 for one of the lines obtained in FIG. 6 and used in the 3-D power spectrum plots.
Figure 8B:
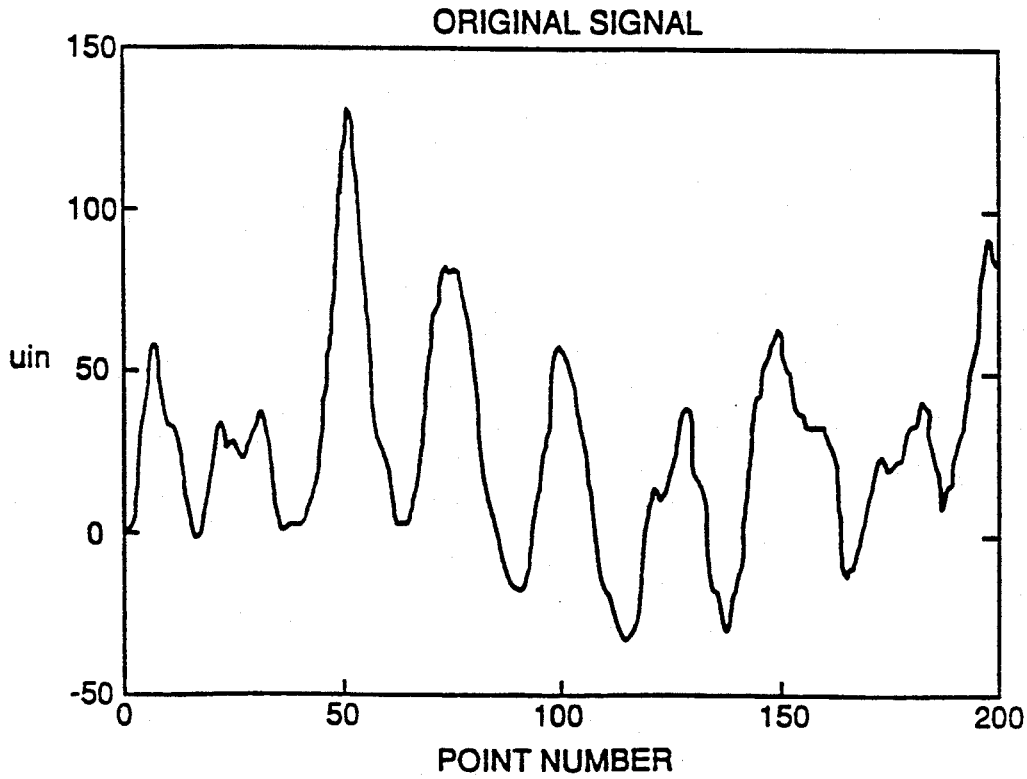
Figure 8C:
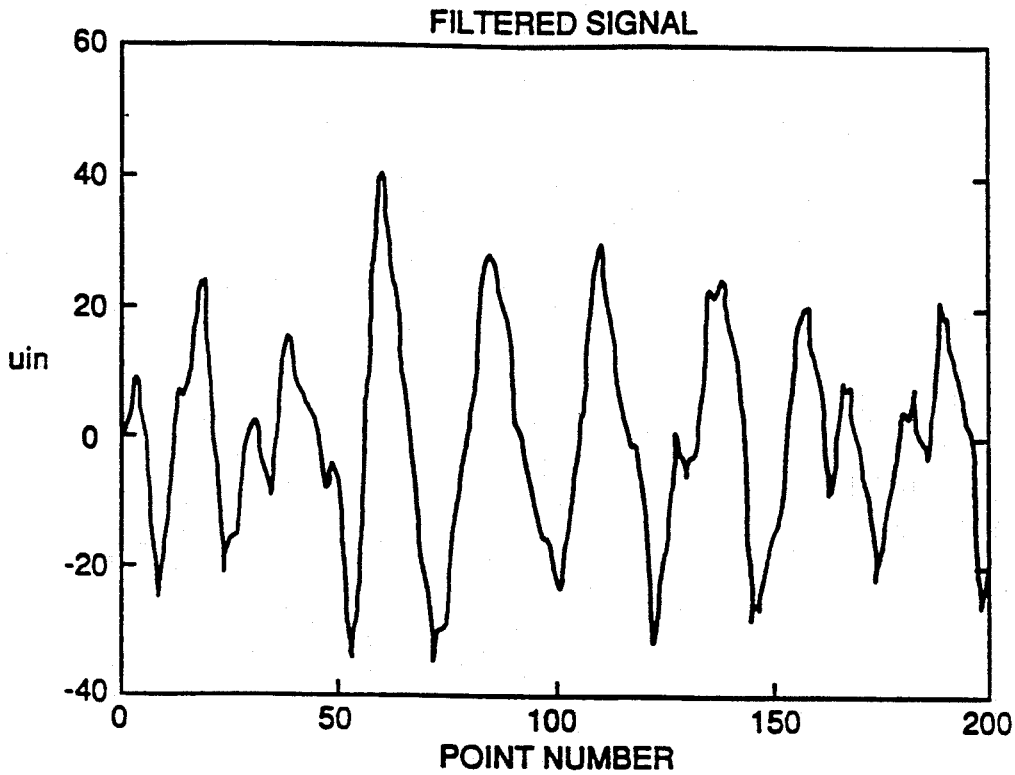
Figure 8D:
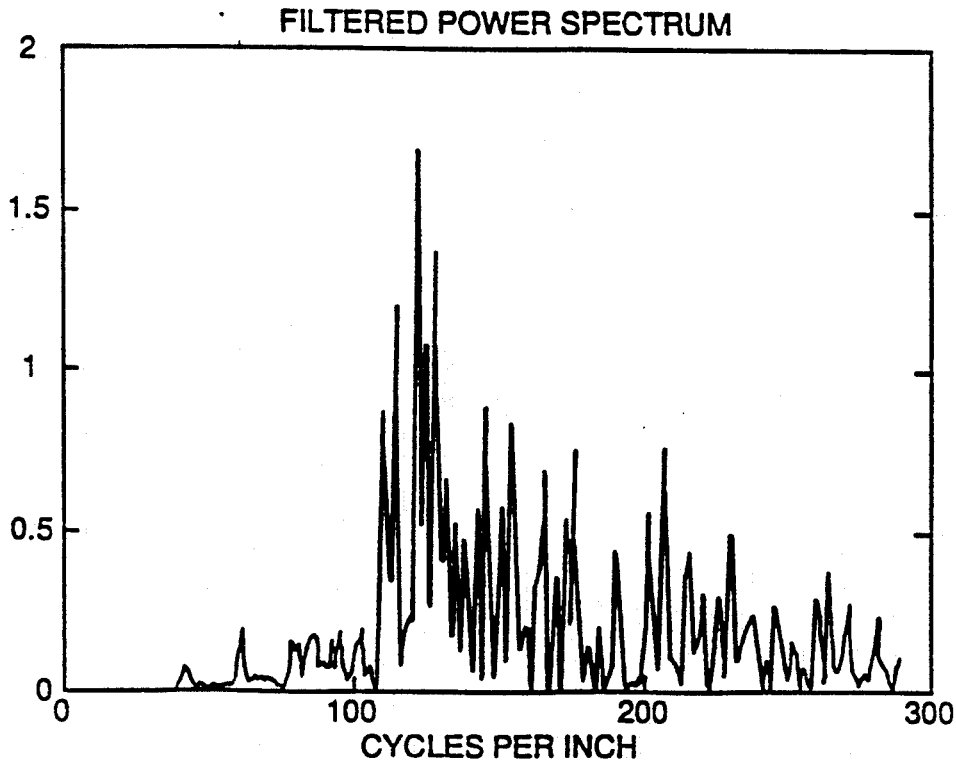

To substantially reduce the relative effect of the unwanted low frequency information and simultaneously enhance the higher frequency data, a conventional software filter was introduced to eliminate frequencies below 50 cycles/inch. FIG. 8 shows the original signal and its spectrum for one of the 20 lines (line #9) used in the 3-D power spectrum plots (FIGS. 8*a* and 8*b*). They also show the same information for the same trace after filtering (FIGS. 8*c* and 8*d*). The effect is striking. The machining induced waviness is replaced by higher frequency information.

Figure 9:
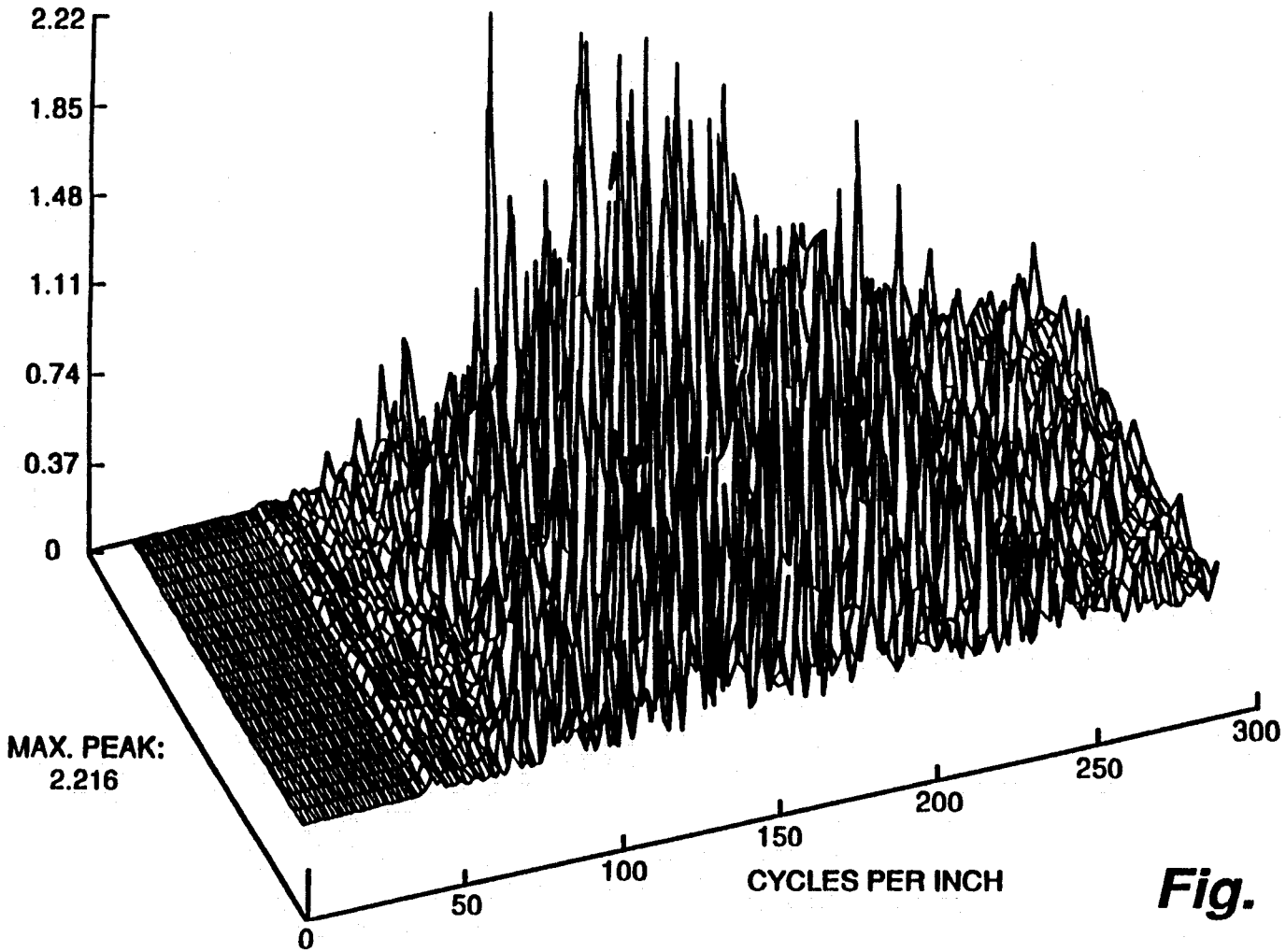
FIG. 9 illustrates the filtered 3-D spectra for the same sample as used in FIG. 6.

FIG. 9 shows the filtered 3-D spectra for the sample. The information in FIG. 9 was obtained by filtering the information from FIG. 6 by conventional filtering techniques using a conventional software filter.

Figure 10:
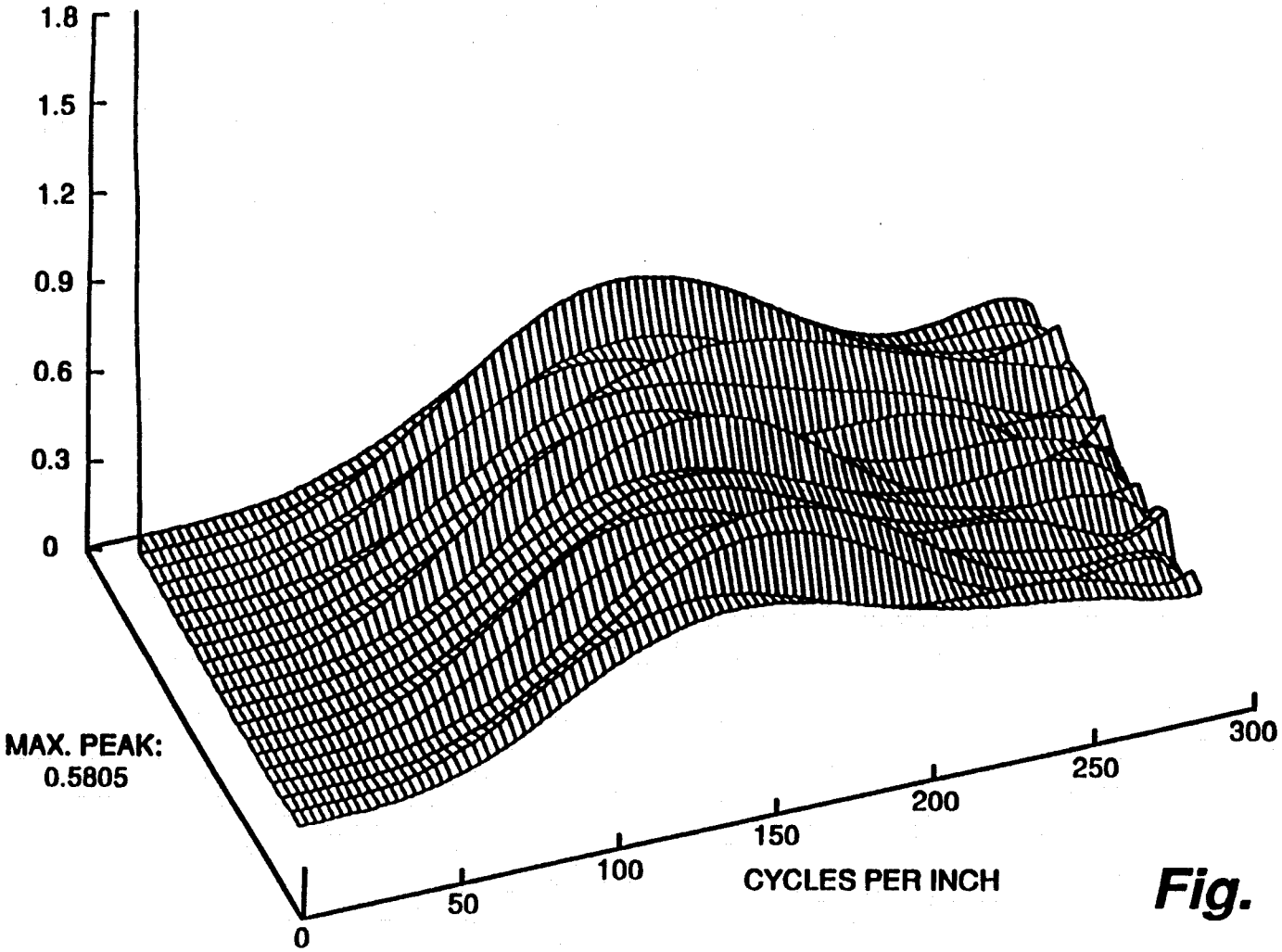
FIG. 10 illustrates the quantized values of the filtered power spectra for the same sample as used in FIG. 6.

To quantize this effect the RMS value of each of the 20 lines constituting the spectra was calculated by conventional RMS calculating methods and plotted by conventional techniques. This information is shown in FIG. 10 for the peening intensities. The coordinates for these curves, preferably, are relative magnitude of the surface waves squared versus spatial wave frequency in cycles/inch. Since the ordinate is the RMS value of a power spectrum, its units are confusing and were omitted. The frequency of the peak of RMS value of each line was averaged to give an overall average frequency of the 20 peaks. This is shown as "Average Peak" under the curves. The average peak should be 146.1 cycles/inch=1/d. The resultant dimple diameter (d) should therefore be d=0.0068" which was, typically, the depth (g) of the plastic rework (compressive) layer determined by microhardness measurements.

Once the surface compression layer depth is known, through the use of the technique set forth above, a system user may adjust the peening operation, if needed, so that the desired results are obtained. For example, adjusting the mass flow or regulation of pressurized air will result in increasing/decreasing the surface compression layer depth. The specific adjustment, of course, depends upon how the desired depth differs from the actual depth.

From the foregoing discussion, it should be apparent that the present method and system provide that the results from a shot peening operation can be determined in a direct and nondestructive 3-D manner, and that shot peening results can be continuously monitored therefore eliminating insensitivity due to process changes. The present invention also provides that accurate results may be obtained for flat as well as contoured surfaces. Importantly, the present invention provides that the results of shot peening operations may be improved by facilitating more accurate control of the peening operations.

Once given the above disclosure, many other features, modifications and improvements will become apparent to the skilled artisan. Such features, modifications and improvements are, therefore, considered to be a part of this invention, the scope of which is to be determined by the following claims.

I claim:

1. A method for monitoring a surface treatment operation, a system user having predetermined a desired total plastic upset depth for said surface treatment, and having predetermined an amount of surface treatment data to be omitted, said method comprising the steps of:

obtaining profile data of a workpiece surface which has been surface treated such that said profile data is being obtained in a nondestructive, direct, and three-dimensional manner;

selecting an area of surface treatment on said workpiece to be analyzed from the obtained profile data of the workpiece;

obtaining power spectra data of said area;

filtering said power spectra data to substantially filter out said predetermined amount of surface treatment data;

calculating an average peak value of said surface treatment from the filtered power spectra data;

calculating an actual plastic upset depth for said selected area based on at least said average peak value; and adjusting, if needed, said surface treatment operation so that the actual total plastic upset depth of a subsequently formed surface treated are should be substantially in conformance with said predetermined desired total plastic upset depth.

2. The method for monitoring said surface treatment operation, according to claim 1, wherein said surface treatment is further comprised of a shot peening operation and/or machining.

3. The method for monitoring said surface treatment operation, according to claim 2, wherein said filtering of said power spectra data comprises the step of:

filtering out said predetermined amount of surface treatment to be omitted such that said machining is substantially filtered out.

4. The method for monitoring said surface treatment, according to claim 1, wherein obtaining profile data comprises the steps of:

scanning said workpiece surface with a 3-D profilometer; and representing said profile data as a function of length versus width versus depth.

5. The method for monitoring said surface treatment, according to claim 1, wherein calculating said actual plastic upset depth further comprises the step of:

calculating $$U \cong d = 2(uD)^{\frac{1}{2}}$$

wherein:

U = total plastic upset depth u = dimple depth, d = dimple diameter, and

D = effective shot diameter

* * * * *